US012065775B2

(12) United States Patent
Lee et al.

(10) Patent No.: US 12,065,775 B2
(45) Date of Patent: Aug. 20, 2024

(54) APPARATUS FOR TREATING LAUNDRY

(71) Applicant: LG Electronics Inc., Seoul (KR)

(72) Inventors: Jihong Lee, Seoul (KR); Kwanwoong Jeong, Seoul (KR); Yeongho Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 430 days.

(21) Appl. No.: 17/406,673

(22) Filed: Aug. 19, 2021

(65) Prior Publication Data

US 2022/0120023 A1 Apr. 21, 2022

(30) Foreign Application Priority Data

Oct. 15, 2020 (KR) ..... 10-2020-0133538

(51) Int. Cl.
*D06F 39/14* (2006.01)
*D06F 39/08* (2006.01)
*D06F 103/40* (2020.01)

(52) U.S. Cl.
CPC ..... *D06F 39/14* (2013.01); *D06F 39/088* (2013.01); *D06F 2103/40* (2020.02)

(58) Field of Classification Search
CPC ..... D06F 29/00; D06F 31/00; D06F 37/24; D06F 34/20; D06F 29/005; D06F 37/18; D06F 37/28; D06F 37/42; D06F 39/14; D06F 23/04; D06F 39/088; D06F 2103/40
See application file for complete search history.

(56) References Cited

U.S. PATENT DOCUMENTS 5,412,825 A * 5/1995 Moon ..... D06F 37/42 68/12.26
9,580,853 B2 * 2/2017 Son ..... D06F 31/00
9,670,609 B2 * 6/2017 Lee ..... D06F 31/00
9,752,267 B2 * 9/2017 Lee ..... D06F 37/267
10,145,051 B2 * 12/2018 Jeong ..... D06F 37/26
10,378,138 B2 * 8/2019 Kim ..... D06F 39/02
(Continued)

FOREIGN PATENT DOCUMENTS

CN 104746300 A * 7/2015 ..... D06F 39/14
CN 104805654 7/2015
(Continued)

OTHER PUBLICATIONS

Extended European Search Report in European Appln. No. 21190983.3, dated Jan. 31, 2022, 10 pages.

*Primary Examiner* — Hiwot E Tefera
(74) *Attorney, Agent, or Firm* — Fish & Richardson P.C.

(57) ABSTRACT

A laundry treating apparatus includes a cabinet, a drawer body, a tub including a tub body disposed within the drawer body to configured to receive water and a tub cover coupled to a top side of the tub body and having a tub entrance configured to receive laundry, a drum disposed within the tub body and configured to accommodate the laundry and having a drum entrance for putting the laundry by communicating with the tub entrance, a driver disposed under a bottom side of the tub body and configured to provide power for rotating the drum, a door configured to slide on a top side of the tub cover to open/close the tub entrance, and a door opening detection sensor disposed at the tub cover to detect an opening/closing of the door by contacting with the door that slides on the tub cover.

21 Claims, 16 Drawing Sheets

(56) References Cited

U.S. PATENT DOCUMENTS

| | | | | |
|---|---|---|---|---|
| 10,407,816 | B2 * | 9/2019 | Lee | D06F 39/12 |
| 2004/0144138 | A1 * | 7/2004 | Takeuchi | D06F 39/14 68/196 |
| 2010/0307200 | A1 * | 12/2010 | Jeong | D06F 29/00 68/13 R |
| 2011/0265271 | A1 * | 11/2011 | Kim | D06F 39/14 8/137 |
| 2011/0298338 | A1 * | 12/2011 | Kim | D06F 29/00 312/109 |
| 2012/0042697 | A1 * | 2/2012 | Hong | D06F 95/00 68/12.23 |
| 2017/0002494 | A1 * | 1/2017 | Lee | D06F 39/00 |
| 2017/0002498 | A1 * | 1/2017 | Lee | D06F 34/20 |
| 2017/0356117 | A1 * | 12/2017 | Lee | D06F 37/42 |
| 2020/0354988 | A1 * | 11/2020 | Dirnberger | E05B 63/0056 |
| 2021/0071337 | A1 * | 3/2021 | Jeon | D06F 23/04 |
| 2022/0064840 | A1 * | 3/2022 | Lee | D06F 37/30 |
| 2022/0120012 | A1 * | 4/2022 | Lee | D06F 37/266 |
| 2022/0120013 | A1 * | 4/2022 | Lee | D06F 39/14 |
| 2022/0120022 | A1 * | 4/2022 | Lee | D06F 37/266 |
| 2022/0396909 | A1 * | 12/2022 | Bodine | D06F 39/14 |

FOREIGN PATENT DOCUMENTS

| | | | |
|---|---|---|---|
| CN | 108374271 | A * | 8/2018 |
| DE | 102008058268 | | 6/2009 |
| EP | 3133202 | | 2/2017 |
| WO | WO2019208964 | | 10/2019 |

* cited by examiner 1355
132
1325

1353
1352
1332

1357
1338
1331
138

1345
1356
134

APPARATUS FOR TREATING LAUNDRY

CROSS-REFERENCE TO RELATED APPLICATIONS

Pursuant to 35 U.S.C. § 119(a), this application claims the benefit of earlier filing date and right of priority to Korean Application No. 10-2020-0133538, filed on Oct. 15, 2020, the contents of which are hereby incorporated by reference herein in their entirety.

TECHNICAL FIELD

The present disclosure relates to a top-load type laundry treating apparatus capable of washing a small quantity of laundry.

BACKGROUND

Generally, a laundry treatment device means a device capable of washing, drying, or washing & drying laundry and the like. Herein, the laundry treatment device may perform a wash or dry function only, or may perform both of the washing function and the drying function. Recently, a steam supplier equipped washer having a refresh function (e.g., wrinkle press-out, deodorization, static electricity removal, etc.) for laundry tends to come into wide use.

These laundry treatment devices are becoming increasingly large in response to user's demands recently. In other words, the appearance sizes of washing machines used for home use are also gradually becoming larger.

Generally, each household is equipped with a large-capacity laundry treatment device to use. Accordingly, the laundry treatment device shall be used several times when washing is performed by classifying laundry according to the types of the laundry. For example, if you want to separate laundry such as adult clothing and laundry such as underwear or baby clothes, the laundry treatment device will be used again for the latter laundry after the former laundry has been completed.

As a result, there was a problem that led to a lot of washing time and a lot of energy consumption. Also, the use of the conventional large laundry treatment device in washing a small quantity of laundry may not be desirable in terms of energy conservation.

For this reason, the need for a smaller laundry treatment device with a much smaller capacity than a conventional large laundry treatment device has emerged. To solve the above problem, a small top-load type laundry treatment device was introduced, which could be subsidiarily provided to the top or bottom of a front-load type laundry treatment device, or independently provided.

The top-load type laundry treatment device may be installed at the top of the front-load type laundry treatment device or at the bottom of the front-load type laundry treatment device as a drawer as needed, thereby washing a small quantity of laundry, making better use of a space, saving water or energy, and washing a small quantity of laundry frequently.

On the other hand, since a tub included in an auxiliary laundry treatment device is relatively low in width, there is a possibility that the water, laundry, or detergent supplied to the tub may be discharged into a tub entrance. To prevent this, the auxiliary laundry treatment device may further include a door to open/close the tub entrance.

In general, the conventional auxiliary garment processing device, disclosed in Korean Publication of Unexamined Patent Applications, No. 2019-0120654 (Open Date: 2019 Oct. 28), includes a door rotatably hinge-coupled to a top side of a tub to open/close a tub entrance.

However, if a main laundry treatment device provided to a top side of the auxiliary laundry treatment device of the related art is provided as a front-load type, the hinge-type door included in the auxiliary laundry treatment device may possibly collide with a front door of the main laundry treatment device.

Moreover, it is disadvantageous in that the hinge-type door of the related art laundry treatment device is not correctly open if a drawer fails to be fully withdrawn from a cabinet.

Moreover, when laundry is put into the related art auxiliary laundry treatment device or the laundry received in the related art laundry treatment device is taken out, the door of the related art laundry treatment device needs to keep a fully-open state. Yet, the hinge-type door disadvantageously needs a fixing member in addition.

Moreover, when water remaining in the tub is discharged after completion of washing, the related art auxiliary laundry treatment device should keep the hinge-type door in an open state after the drawer has been withdrawn. Thus, when the tub is dried, the related art auxiliary laundry treatment device disadvantageously requires an additional space for withdrawing the drawer from the cabinet.

Furthermore, when the tub of the auxiliary laundry treatment device is dried, the drawer withdrawn from the cabinet interrupts a user's motion to cause inconvenience, and there is a possibility that there will be a risk of injury as the user trips over the drawer withdrawn from the cabinet.

SUMMARY

Accordingly, embodiments of the present disclosure are directed to an apparatus for treating laundry that substantially obviates one or more problems due to limitations and disadvantages of the related art.

One technical task of the present disclosure is to provide a laundry treatment apparatus including a door slidable along a top side of a tub.

Another technical task of the present disclosure is to provide a laundry treatment apparatus including a door opening detection sensor provided to a top side of a tub to detect opening or closing of a door.

Another technical task of the present disclosure is to provide a laundry treatment apparatus including a door opening detection sensor configured to detect a closing of a door only if the door completely covers a tub entrance provided to a top side of a tub or an opening of the door if the door fails to completely cover the tub entrance.

Another technical task of the present disclosure is to provide a laundry treatment apparatus including a sliding-type door free from colliding with a front door of a main laundry treatment device of a front-load type even if the main laundry treatment device is provided above the laundry treatment apparatus.

Another technical task of the present disclosure is to provide a laundry treatment apparatus including a door that can be correctly open despite that a drawer fails to be fully withdrawn from a cabinet.

Another technical task of the present disclosure is to provide a laundry treatment apparatus including a door capable of keeping a fully-open state without an additional fixing member when laundry is put into or withdrawn from a tub.

Further technical task of the present disclosure is to provide a laundry treatment apparatus unnecessary to withdraw a drawer from a cabinet in removing water remaining in a tub.

Technical tasks obtainable from the present disclosure are non-limited by the above-mentioned technical tasks. And, other unmentioned technical tasks can be clearly understood from the following description by those having ordinary skill in the technical field to which the present disclosure pertains.

Additional advantages, objects, and features of the disclosure will be set forth in the disclosure herein as well as the accompanying drawings. Such aspects may also be appreciated by those skilled in the art based on the disclosure herein.

A laundry treatment apparats according to exemplary embodiments of the present disclosure may include a door provided over a top side of a tub so as to be slidable along the top side of the tub, and the door may be configured to detect an opening or closing via a door opening detection sensor provided to the top side of the tub to selectively contact with the door.

To achieve these objects and other advantages and in accordance with the purpose of the disclosure, as embodied and broadly described herein, an apparatus for treating laundry according to one embodiment of the present disclosure may include a cabinet having an opening portion provided to a front side, a drawer body configured withdrawable by being inserted in the opening portion, a tub including a tub body configured within the drawer body to provide a space for storing water therein and a tub cover coupled to a top side of the tub body and having a tub entrance for putting the laundry, a drum rotatably configured within the tub body to provide a space for storing the laundry therein and having a drum entrance for putting the laundry by communicating with the tub entrance, a driver configured under a bottom side of the tub body to provide a power for rotating the drum, a door configured slidable on a top side of the tub cover to open/close the tub entrance, and a door opening detection sensor configured on the one side of the tub cover to detect an opening/closing of the door by contacting with the door selectively owing to a sliding of the door.

The tub cover may include a first guide rail provided to at least one of both sides of the tub entrance on the one side of the tub cover to guide the door to slide to cover the tub entrance and the door opening detection sensor may be configured capable of contacting with the door if the door slides to one end of the first guide rail.

The first guide rail may include a first bent portion configured on one end of the first guide rail to guide the door to ascend by a prescribed height when closed and the door opening detection sensor may be configured to contact with the door if the door slides to the first bent portion.

The first guide rail may be extended side by side with the one side of the tub cover and then inclined to extend downward on passing the first bent portion.

The door may include a first guide projection coupled to a position corresponding to the first guide rail on a bottom side of the door and configured to be movable while contacting with the first guide rail. When the first guide projection is located at one end of the first guide rail, the door opening detection sensor may detect the closing of the door by contacting with the door. When the first guide projection is located at a rest portion except the one end of the first guide rail, the door opening detection sensor may detect the opening of the door by not contacting with the door.

The tub cover may further include a second guide rail configured in rear of the tub entrance on the one side of the tub cover to guide the door to slide to cover the tub entrance and the door opening detection sensor may be configured to be capable of contacting with the door if the door slides up to one end of the second guide rail.

The second guide rail may include a second bent portion configured at one end of the second guide rail to guide the door to descend by a prescribed height when closed. The door opening detection sensor may be configured to be capable of contacting with the door if the door slides to the second bent portion.

The door may further include a second guide projection coupled to a position corresponding to the second guide rail on the bottom side of the door and configured to be movable while contacting with the second guide rail. The door opening detection sensor may detect the closing of the door by contacting with the door when the second guide projection is located at the second bent portion. The door opening detection sensor may detect the opening of the door by not contacting with the door when the second projection is located at a rest portion except the second bent portion.

The tub cover may include a sensor coupling part configured on the one side of the tub cover to have the door opening detection sensor coupled thereto and the sensor coupling part may be disposed in rear of the tub entrance on the one side of the tub cover.

The tub cover may further include a door seat part covering at least one portion of a top side of the tub cover and having the door seated thereon and the door seat part may include a sensor exposing part configured at a position corresponding to the sensor coupling part.

A portion of the door opening detection sensor may be exposed above the door seat part through the sensor exposing part while coupled to the sensor coupling part.

The door may further include a detection projection coupled to a position corresponding to the sensor exposing part on the bottom side of the door and the detection projection may be configured to be capable of contacting with a portion of the door opening detection sensor by passing the door seat part through the sensor exposing part.

The door opening detection sensor may include a sensor body seated on the one side of the tub cover and a switch part configured on one side of the sensor body and n the switch part may include a door contact part extended from the sensor body to be capable of contacting with the door and a moving member configured between the sensor body and the door contact part to be retractable into the sensor body.

The door opening detection sensor may detect the closing of the door in a manner that the door contact part contacts with the door to push the moving member into the sensor body when the door is closed.

The tub cover may include a first guide rail configured on at least one of both sides of the tub entrance on the one side of the tub cover to guide the door to slide and a second guide rail configured in rear of the tub entrance on the one side of the tub cover to guide the door to slide, the tub cover may further include a sensor coupling part configured on the one side of the tub cover to have the door opening detection sensor coupled thereto, and the sensor coupling part may be disposed in a manner of being spaced apart from the second guide rail.

The door may include a first guide projection configured to be movable while contacting with the first guide rail by being coupled to a position corresponding to the first guide rail on a bottom side of the door and a second guide projection configured to be movable while contacting with the second guide rail by being coupled to a position corresponding to the second guide rail on the bottom side of the door, the door may further include a detection projection coupled to a position corresponding to the sensor coupling part of the door, and the detection projection may be disposed in a manner of being spaced apart from the second guide projection.

The door opening detection sensor may include a sensor body seated on the one side of the tub cover and a switch part configured on one side of the sensor body and the detection projection may be disposed in a manner of being aligned with at least one portion of the switch part when viewed above.

The detection projection may be configured to contact with the switch part by descending by a prescribed height on closing the door or not to contact with the switch part by ascending by a prescribed height on opening the door and the door opening detection sensor may detect the opening or closing of the door based on a presence or non-presence of a contact between the detection projection and the switch part.

In another aspect of the present disclosure, as embodied and broadly described herein, an apparatus for treating laundry according to one embodiment of the present disclosure may include a cabinet having an opening portion provided to a front side, a drawer body configured withdrawable by being inserted in the opening portion, a tub including a tub body configured within the drawer body to provide a space for storing water therein and a tub cover coupled to a top side of the tub body and having a tub entrance for putting the laundry, a drum rotatably configured within the tub body to provide a space for storing the laundry therein and having a drum entrance for putting the laundry by communicating with the tub entrance, a driver configured under a bottom side of the tub body to provide a power for rotating the drum, a door configured slidable along one side of the tub cover by being coupled to a top side of the tub to cover the tub entrance, and a door opening detection sensor configured on the one side of the tub cover to detect an opening/closing of the door, the door opening detection sensor including a sensor body seated on the one side of the tub cover and a switch part configured on one side of the sensor body, the door opening detection sensor may detect a state that the door contacts with the switch part as the closing of the door, and the door opening detection sensor may detect a state that the door fails to contact with the switch part as the opening of the door.

The switch part may include a door contact part extended from the sensor body to be capable of contacting with the door and a moving member configured between the sensor body and the door contact part to be retractable into the sensor body, the door opening detection sensor may detect a state that the moving member is retracted into the sensor body by the door contact part as the closing of the door, and the door opening detection sensor may detect a state that the moving member is not retracted into the sensor body as the opening of the door.

The door may further include a detection projection coupled to a position corresponding to one end of the door contact part on the bottom side of the door, the detection projection may be configured to contact with the door opening detection sensor in a closed state of the door, and the detection projection may be configured not to contact with the door opening detection sensor in an open state of the door.

The door may be configured to descend by a prescribed height when the open state is switched to the closed state, the detection projection may be configured to descend by a prescribed height together with the door, and the door opening detection sensor may detect the opening/closing of the door based on retracting the moving member into the sensor body as the detection projection descends to push out the door contact part.

Accordingly, the present disclosure provides the following effects and/or advantages.

A laundry treatment apparatus according to exemplary embodiments of the present disclosure may include a door slidable along a top side of a tub.

The door included in the laundry treatment apparatus may be free from colliding with a front door of a main laundry treatment device of a front-load type even if the main laundry treatment device is provided above the laundry treatment apparatus.

The door of the laundry treatment apparatus may be correctly open despite that a drawer fails to be fully withdrawn from a cabinet.

The door of the laundry treatment apparatus may not need an additional fixing member to keep a fully-open state when laundry is put into or withdrawn from the laundry treatment apparatus.

When water remaining in the tube is removed after completion of washing, the laundry treatment apparatus can keep the open state by enabling the door to slide irrespective of a presence or non-presence of withdrawal of the drawer. Therefore, the drawer does not need to be withdrawn from the cabinet, whereby an additional space for withdrawing the drawer from the cabinet may unnecessary in drying the tub.

When the tub is dried, the drawer does not need to be withdrawn from the cabinet. Hence, the laundry treatment apparatus may avoid the inconvenience caused by the drawer withdrawn from the cabinet to interrupt a user's motion and further lower a possibility that there will be a risk of injury as the user trips over the drawer withdrawn from the cabinet.

The laundry treatment apparatus according to exemplary embodiments of the present disclosure may include a door opening detection sensor configured to detect opening or closing of the door in a manner of selectively contacting with the door as the door slides.

Therefore, although the door fails to be rotatably hinge-coupled to the top side of the tub, the opening/closing of the door can be detected effectively.

Effects obtainable from the present disclosure may be non-limited by the above-mentioned effects. And, other unmentioned effects can be clearly understood from the following description by those having ordinary skill in the technical field to which the present disclosure pertains.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. The above and other aspects, features, and advantages of the present disclosure will become more apparent upon consideration of the following description of preferred embodiments, taken in conjunction with the accompanying drawing figures.

DETAILED DESCRIPTION

Reference will now be made in detail to the preferred embodiments of the present disclosure, examples of which are illustrated in the accompanying drawings. A detailed description below is provided to assist in a comprehensive understanding of the methods, devices, and/or systems described in this specification. However, this is just an example, by which the idea of the present disclosure is non-limited.

In explaining embodiments of the present disclosure, if it is deemed that a specific description of the prior art related to the present disclosure may unnecessarily blur the gist of the present disclosure, the detailed description shall be omitted. Furthermore, the terms described below are those defined in consideration of their functions in the present disclosure, which may depend on the intentions or practices of the user, operator, etc. The definition will therefore have to be based on the full text of the present specification. The terms used in the detailed description are simply to describe embodiments of the present disclosure and should never be limited. Unless clearly used differently, singular forms of expression contain multiple forms of meaning. In this description, an expression such as "include" or "provide" is intended to refer to some characteristics, numbers, steps, operations, elements, or combinations thereof, and should not be interpreted to exclude the existence or possibility of one or more other characteristics, numbers, steps, operations, elements, or combinations thereof.

In addition, terms such as first, second, A, B, (a) and (b) may be used to describe the components of the embodiments of the present disclosure. These terms are intended to distinguish the component from other components, but non-limit the nature, turn, order or the like of the component.

Figure 1:
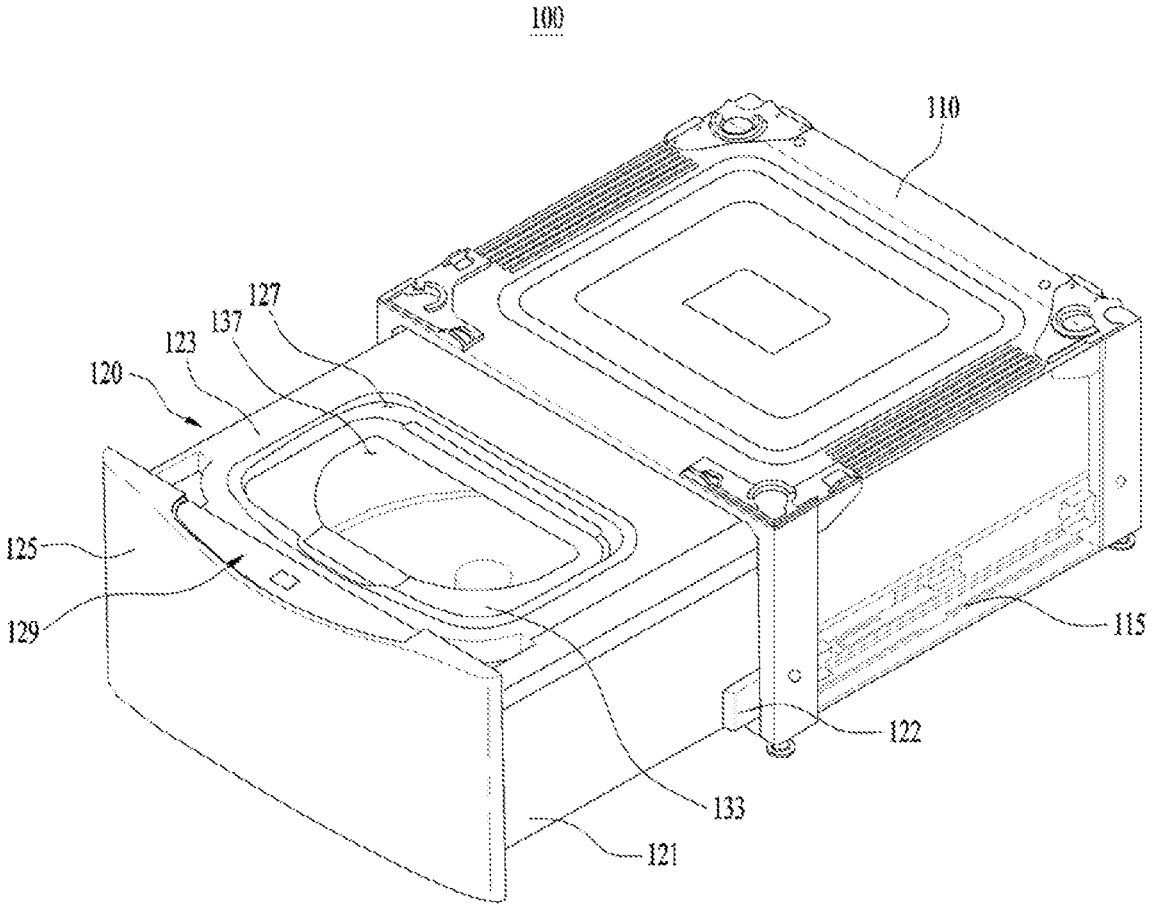
FIG. 1 shows an exterior of a laundry treatment apparatus according to the present disclosure.
Figure 2:
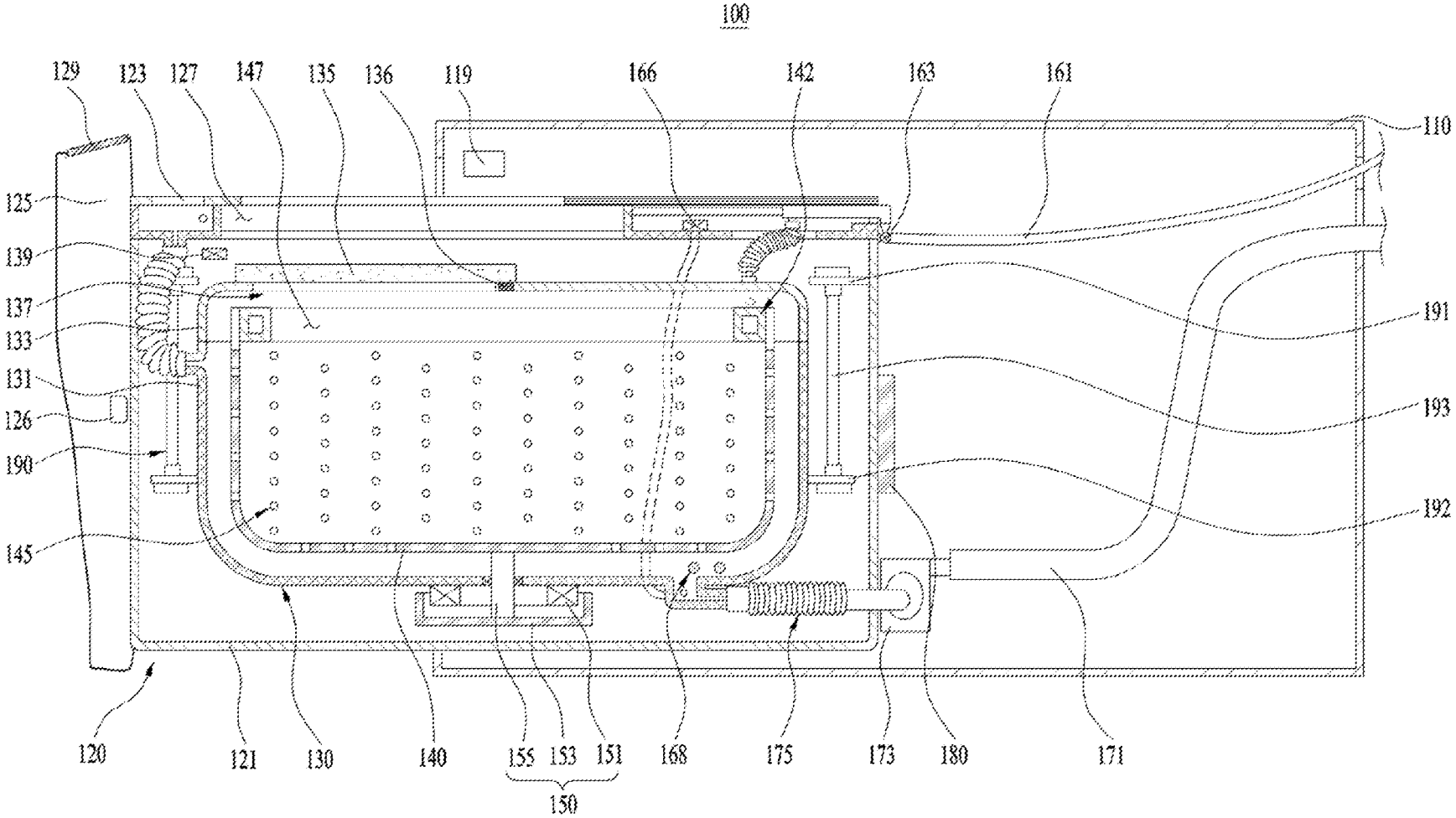
FIG. 2 shows an inner structure of a laundry treatment apparatus according to the present disclosure.

FIG. 1 shows an exterior of a laundry treatment apparatus according to the present disclosure, and FIG. 2 shows an inner structure of the laundry treatment apparatus according to the present disclosure.

FIG. 1 shows a basic configuration of a laundry treatment apparatus according to the present disclosure, and FIG. 2 shows a cross-sectional view of an inner structure of the laundry treatment apparatus according to the present disclosure.

Referring to FIG. 1 and FIG. 2, a laundry treatment apparatus 100 according to the present disclosure may include a tub 120 storing water therein, a drum rotatably provided within the tub 120 to receive laundry therein, and a driver 150 coupled to a bottom of the tub 120 to rotate the drum 130.

Here, the laundry treatment apparatus 100 according to the present disclosure may include a housing 110 and 120 provided with the tub 120. The housing 110 and 120 may be configured in a box shape having a height smaller than a width.

The housing 110 and 120 may include a cabinet 110 configured to receive the tub 120 therein.

The cabinet 110 may be configured in a box shape having a height smaller than a width.

In some implementations, the housing 110 and 120 may include a drawer 120 configured to receive the tub 120 therein and provided to the cabinet 110 to be withdrawable therefrom.

In other words, as shown in FIG. 1 and FIG. 2, the laundry treatment apparatus 100 according to the present disclosure may be a drawer type, by which the idea of the present disclosure is non-limited. Alternatively, the laundry treatment apparatus 100 according to the present disclosure may include a general cabinet by excluding a drawer.

The following description will be made based on that the laundry treatment apparatus 100 according to the present disclosure includes a laundry treatment apparatus 100 having the cabinet 110 provided with the withdrawable drawer 120. In addition, the laundry treatment apparatus 100 according to the present disclosure may include a top-load type laundry treatment apparatus. In this case, a front-load type laundry treatment apparatus may be defined as a laundry treatment apparatus including an opening provided to a front side and having a rotation axis of a drum set parallel to a ground surface or with a predetermined inclination, and a top-load type laundry treatment apparatus may be defined as a laundry treatment apparatus including an opening provided to a top side and having a rotation axis of a drum set vertical to a ground surface.

Referring to FIG. 1, a laundry treatment apparatus 100 according to the present disclosure may include a cabinet 110 forming an exterior and having an opening provided to a front side and a drawer 120 provided within the cabinet 110.

The drawer 120 may include a drawer body 121 configured to be withdrawable by being inserted in the opening and a drawer cover 123 coupled to a top side of the drawer body 121. A front panel 125 including a controller 129 manipulated by a user may be coupled to a front side of the drawer body 121. In this case, the front panel 125 may further include a drawer lock part 126 provided within the front panel 125 to control the drawer 120 not to be withdrawn from the cabinet 110.

A drawer guide rail 115 guiding the drawer to be withdrawn may be provided to an inner circumference of an inside of the cabinet 110, and a drawer guide rail coupling part 122 slidable along the drawer guide rail 115 may be provided to a rear portion of the drawer 120.

In some implementations, the laundry treatment apparatus 100 according to the present disclosure may further include a tub 130 provided within the drawer body 121 to store water therein and a drum 140 rotatably provided within the tub 130 to store laundry therein.

A tub entrance 137 for putting laundry into the tub 120 may be provided to a top side or surface of the tub 120, and the drum 140 may include a drum entrance 147 communicating with the tub entrance 137 to enable laundry to enter the drum 140.

The laundry treatment apparatus 100 according to the present disclosure is usable as an auxiliary laundry treatment apparatus and may be disposed above or below a main laundry treatment apparatus. To reinforce accessibility of the main or auxiliary laundry treatment apparatus, the tub 120 and drum 140 of the laundry treatment apparatus 100 according to the present disclosure may be configured to have a height smaller than a width. Namely, each of the tub 120 and the drum 140 may have a height smaller than a diameter.

In some implementations, the laundry treatment apparatus 100 according to the present disclosure may be configured as a drawer type to dispose the main laundry treatment apparatus, other auxiliary laundry treatment apparatuses and the like.

The tub 130 is provided within the drawer body 121 to be moved together with the drawer 120 when the drawer 120 is withdrawn or inserted.

The drawer body 121 may be configured in a hexahedral shape, and the drawer cover 123 may include an opening part 127 provided to a top side thereof to communicate with the tub entrance 137.

In some implementations, the laundry treatment apparatus 100 according to the present disclosure may further include a controller 129 configured to receive an input of a command for operating the laundry treatment apparatus 100 according to the present disclosure for washing, rinsing, dewatering and the like of the laundry treatment apparatus or display statuses of the laundry treatment apparatus.

The controller 129 may be provided to a top side of the front panel 125. If the drawer 120 is not provided, the controller 129 may be provided to one side of the cabinet 110.

The controller 129 may include a display unit (not shown) displaying a state of the laundry treatment apparatus, an input unit (not shown) receiving an input of an operation command of the laundry treatment apparatus, and a control unit (not shown) controlling an operation of the laundry treatment apparatus.

The display unit may include a display panel such as LCD, LED, etc., and a speaker forwarding information to a user by generating sound. Namely, the display unit may display information of the laundry treatment apparatus to a user or make an alarm sound for notifications.

In some implementations, as the tub 130 of the laundry treatment apparatus 100 according to the present disclosure has a height relatively smaller than a width, there is a possibility that water, laundry or detergent supplied to the tub 12 may be discharged through the tub entrance 137.

To prevent this, the laundry treatment apparatus 100 according to the present disclosure may further include a door 135 capable of opening/closing the tub entrance 137. The door 135 is coupled to the top side of the tub 130 so as to cover the tub entrance 137 and may be configured to be slidable along the top side of the tub 130.

Particularly, the tub 130 may include a tub body 131 provided within the drawer body 121 to form a space for storing water therein and a tub cover 133 coupled to a top side of the tub body 131 and provided with a tub entrance 137 for inserting laundry. In addition, a door 135 configured to cover the tub entrance 137 may be coupled to a top side of the tub cover 133 in a manner of being slidable along one surface of the tub cover 133, and a door opening detection sensor 136 may be further provided to the one surface of the tub cover 133 to detect the opening/closing of the door 135 in a manner of contacting with the door 135.

In some implementations, the laundry treatment apparatus 100 according to the present disclosure may further include a control part 180 provided within the cabinet 110 to control a water supply valve 163, a drain pump 173 and the driver 150. The control part 180 may be coupled to a rear side of the drawer 120 and include a Printed Circuit Board (PCB) configuring electronic circuit.

Referring to FIG. 2, the laundry treatment apparatus 100 may include a water supply part 160 supplying water to the tub 130 and a drain part 170 draining the water of the tub 130.

The water supply part 160 may include a water supply pipe 161 supplying water from an external water supply source and a water supply valve 163 determining whether to open or close the water supply pipe 161.

The drain part 170 may include a drain pipe 175 communicating with a bottom side of the tub 130 to drain the water of the tub, a drain pump 173 providing power of draining the water of the drain pipe 175 out of the cabinet 110, and a discharge pipe 171 communicating with the drain pump 173 to discharge the water of the tub from the cabinet 110.

The water supply pipe 161 and the discharge pipe 171 may be supported by a guide part 200 that will be described later. When the drawer 120 is inserted in or withdrawn from the cabinet, operations of the water supply pipe 161 and the discharge pipe 171 may be guided via the guide part 200. The guide part 200 will be described in detail with reference to FIG. 6 later.

In some implementations, the laundry treatment apparatus 100 may further include a support part 190 supporting the tub 130 in the cabinet 110 or the drawer 120 and attenuating vibration generated from the tub 130 to prevent the vibration from being transferred to the cabinet 110.

The support part 190 may include a damper, a spring, or a combination of the damper and spring. A plurality of the support parts 190 may be provided.

The support part 190 may be provided to a top or bottom side of the tub 130 or both of the top and bottom sides of the tub 130. Meanwhile, since the laundry treatment apparatus 100 according to the present disclosure may be provided as an auxiliary laundry treatment apparatus, the support part 190 is preferably provided to a lateral side of the tub 130 due to the limited height of the laundry treatment apparatus 100.

The support part 190 may include a first support part 191 provided to an inner lateral side of the cabinet 110 or the drawer 120, a second support part 192 provided to an outside of the tub 130, and a connecting part 193 connecting the first and second support parts 191 and 192 together.

The first support part 191 may be provided above the second support part 192, the connecting part 193 may be fixed in a manner that one end of the connecting part 193 is coupled to the first support part 191, and the other end may support the second support part 912. Thus, the tub 120 may be fixed to and supported by the cabinet 110 or the drawer 120.

In some implementations, a water level detection sensor 166 detecting a water level of the tub 130 may be provided to one side of the tub 130, and a temperature sensor (not shown) detecting a temperature of the tub 130 may be provided to an inner circumference of the tub 130.

In some implementations, the laundry treatment apparatus 100 may include a driver 150 rotating the drum 140 in the tub 130.

The driver 150 may include a stator 151 fixed to a bottom surface of the tub 130 to generate a rotating magnetic field, a rotor 153 rotated by the rotating magnetic field of the stator 151, and a drive rotation shaft 155 perforating the tub to be rotated by the rotor 153.

In some implementations, the drum 140 may have a drum entrance 147 communicating with the tub entrance 137 and include a balancer 142 coupled to an outer circumference of the drum entrance 147 to prevent eccentricity of the drum 140.

Meanwhile, the drum 140 may include a multitude of perforated holes 145 formed in an inner circumference of the drum 140 so that the water of the tub 130 can enter or leave the drum 140 through the perforated holes 145.

The drum 140 is rotated by the power provided by the driver 150, thereby applying a mechanical force to laundry received in the drum 140 to perform washing.

In addition, the drum 140 is rotated by the power provided by the driver 150, thereby progressing a dewatering course of discharging water contained in the laundry through the perforated holes 145.

The laundry treatment apparatus 100 may further include a stirring part (not shown) provided to a floor surface of the drum 140 to stir the laundry in a manner of being rotatable separately from the drum 140.

In some implementations, the laundry treatment apparatus 100 may further include a drawer withdrawal detection sensor 136 provided within the drawer body 121 to detect whether the drawer body 121 is withdrawn. The drawer withdrawal detection sensor 136 may detect whether the drawer is withdrawn via a magnetic force with a permanent magnet 119 provided to one side of the cabinet 110. The drawer withdrawal detection sensor 136 may be configured to further detect whether a main laundry treatment apparatus is stacked above the laundry treatment apparatus 100.

In some implementations, the laundry treatment apparatus 100 may further include a heater 168 provided between the tub 130 and the drum 140 to raise the temperature of the water stored in the tub 130.

Figure 3:
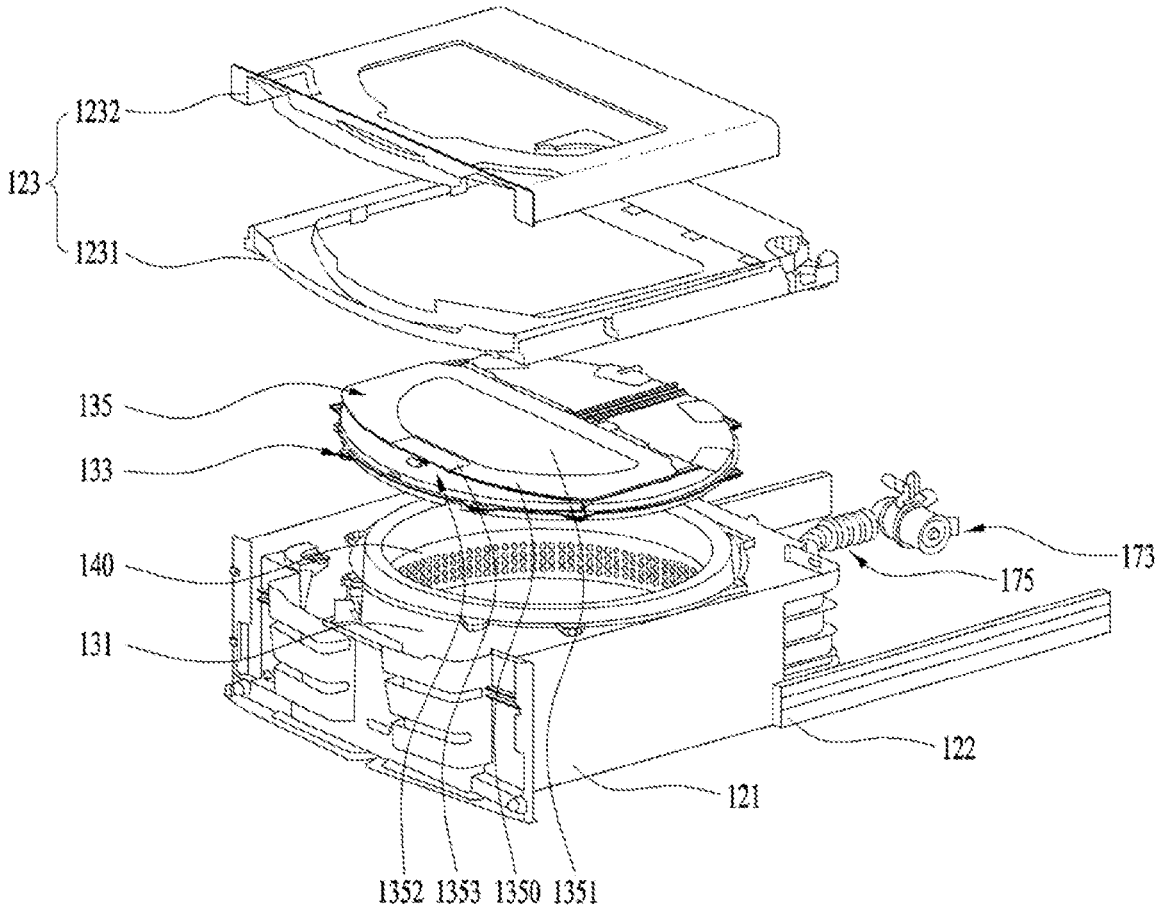
FIG. 3 is an exploded perspective diagram showing a configuration of a laundry treatment apparatus according to the present disclosure.
Figure 4:
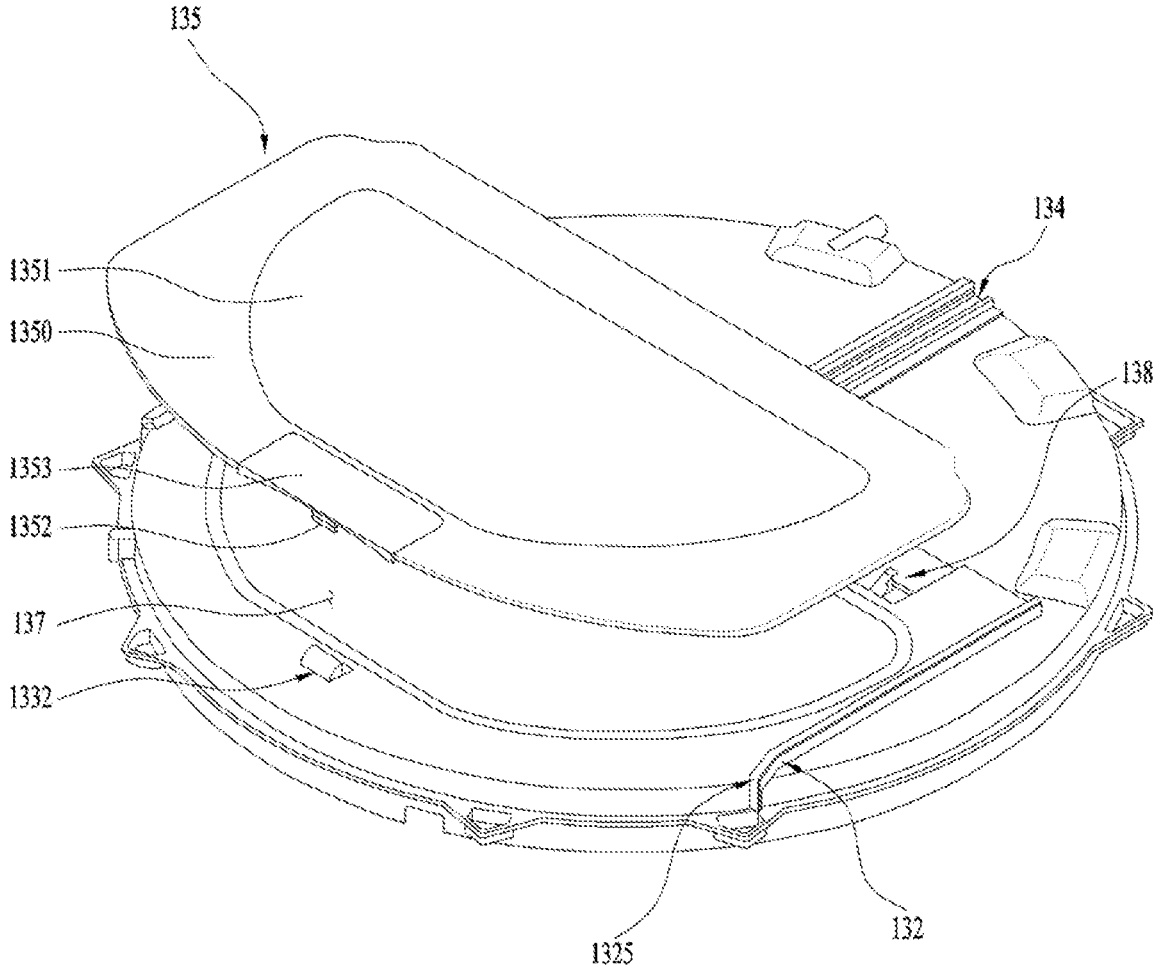
FIG. 4 and FIG. 5 are exploded perspective diagrams of a tub cover and a door of the present disclosure, respectively.
Figure 5:
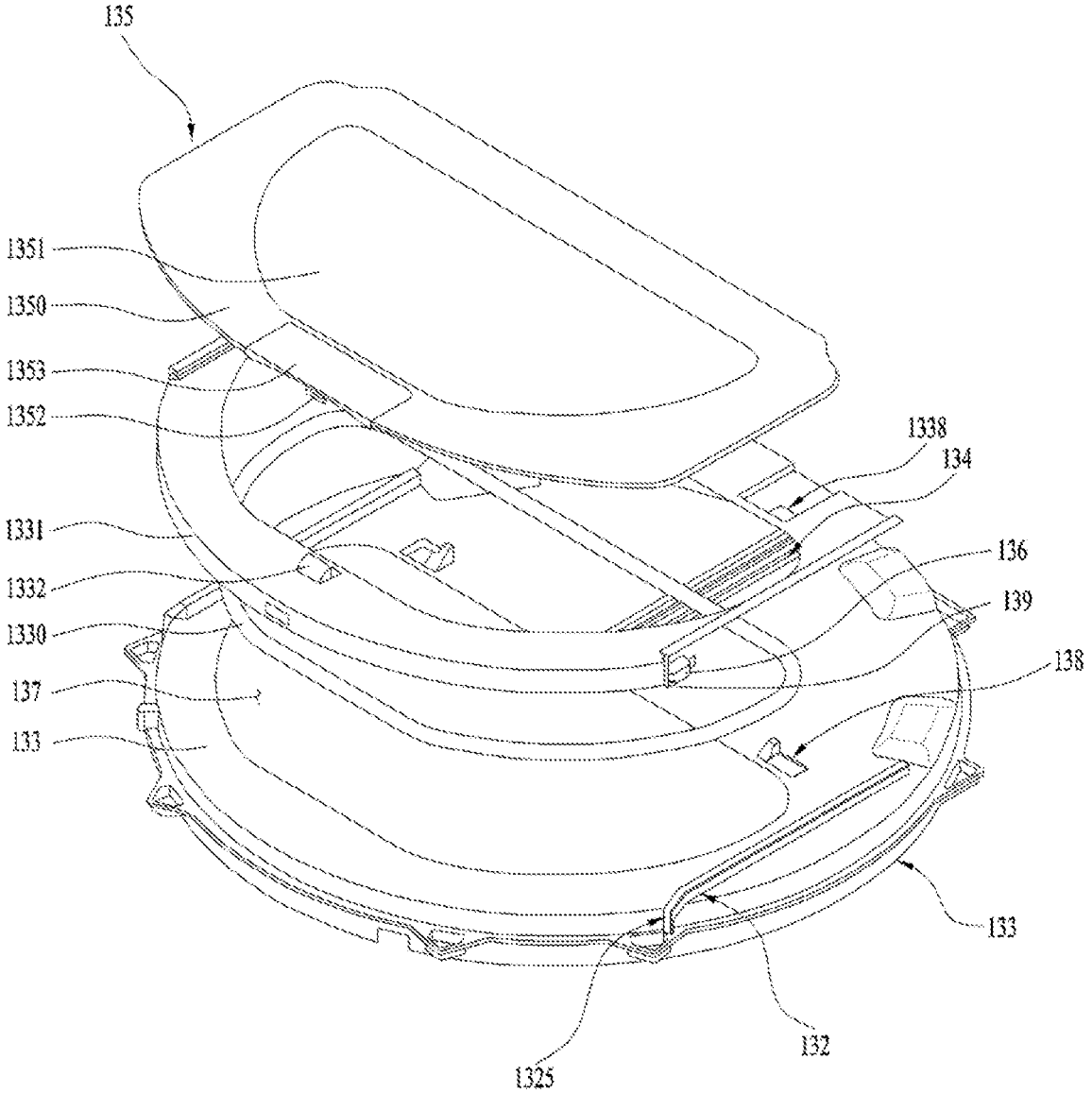
Figure 6:
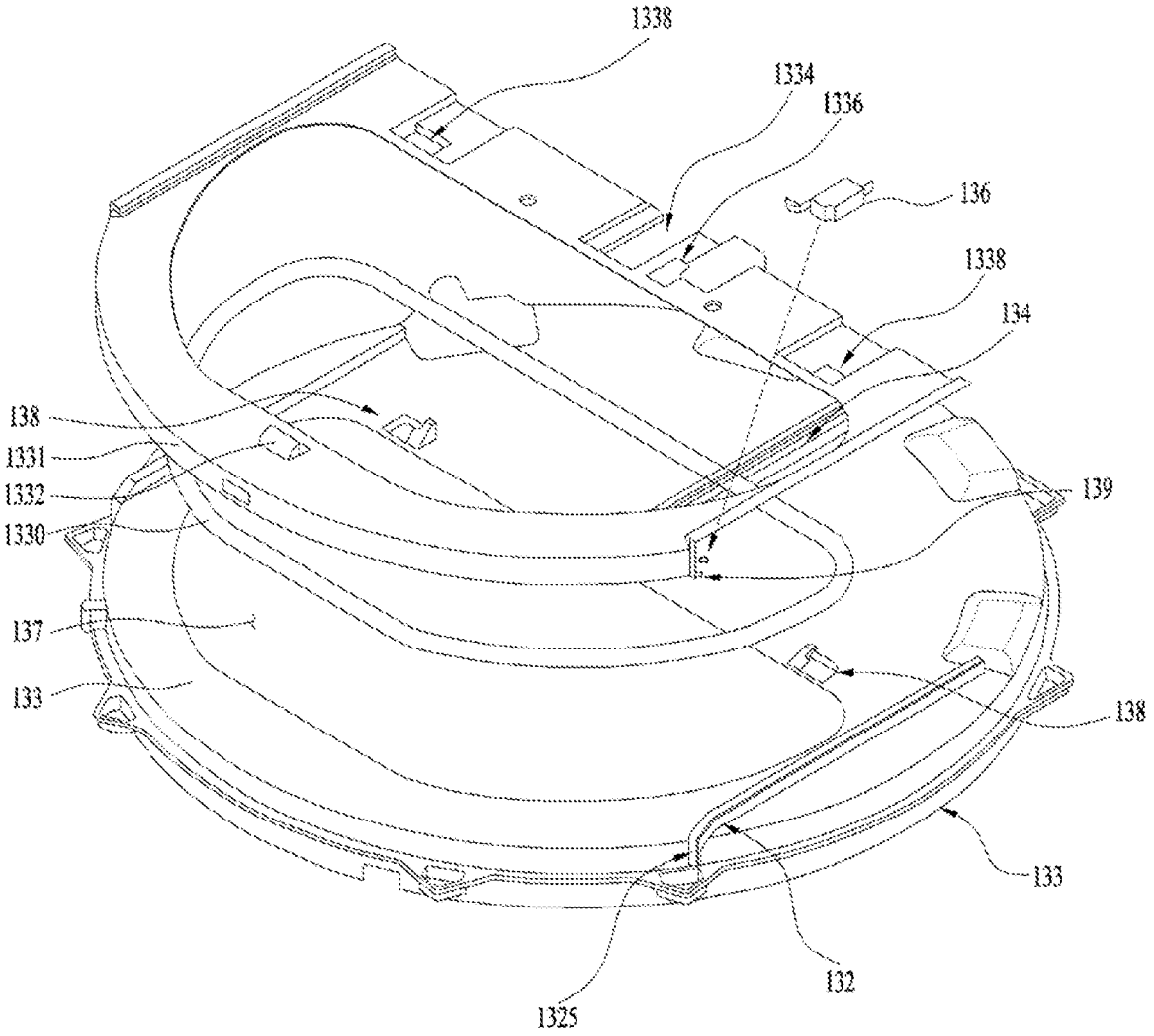
FIG. 6 is an exploded perspective diagram of a door seat part and a sensor seat part of the present disclosure.

FIG. 3 is an exploded perspective diagram showing a configuration of the laundry treatment apparatus 100 according to the present disclosure, FIG. 4 and FIG. 5 are exploded perspective diagrams of a tub cover and a door of the present disclosure, respectively, and FIG. 6 is an exploded perspective diagram of a door seat part and a sensor seat part of the present disclosure.

Referring to FIG. 3, the tub cover 133 and the door 135 included in the laundry treatment apparatus 100 according to the present disclosure may be stacked over the top side the tub body 131 in order, and the drawer cover 123 exposing the door 135 in part at least may be coupled to a top side of the tub cover 133.

The drawer cover 123 may include a bottom cover 1231 coupled to the top side of the tub cover 133 and a top cover 1232 coupled to a top side of the bottom cover 1231, and a drawer entrance 127 exposing the door 135 may be provided to a central portion of the bottom cover 1231 and a central portion of the top cover 1232.

Here, the door 135 may include a door frame 1350 provided to correspond to a shape of the tub entrance 137, a window provided within the door frame 135*o* to check a state of an inside of the tub 130, and a door coupling part 1352 configured to fix the door 135 to the tub cover 133 when the door frame 1350 and the window 1351 close the tub entrance 137. The coupling part 1352 may be provided with a handle 1353 to facilitate the door 135 to be opened.

Referring to FIG. 4, the door 135 is slidably provided to the top side of the tub cover 133 so as to open/close the tub entrance 137.

In particular, the tub cover 133 may include a first guide rail 132 provided to at least one of both sides of the tub entrance 137 on one side, i.e., the top side of the tub cover 133 so as to guide the door 135 to slide to cover the tub entrance 137.

Accordingly, the door 135 may be guided to slide in a correct direction along the top side of the tub cover 133 by the first guide rail 132, and be also prevented from being separated from the top side of the tub cover 133. In this case, as shown in FIG. 4, the first guide rail 132 may be provided to each of both sides of the tub entrance 137 on the top side of the tub cover 133, by which the idea of the present disclosure is non-limited. Optionally, the number of the first guide rail(s) 132 may be equal to or smaller than 1 or equal to or greater than 3.

According to the exemplary embodiments, the door 135 may slide on the top side of the tub cover 133 along the first and second guide rails 132 and 134. In this case, if the door 135 slides in a rear direction, the tub entrance 137 may be open. If the door 135 slides in a front direction, the tub entrance 137 may be closed. Thus, the tub entrance 137 may be open/closed by the sliding of the door 135.

The first guide rail 132 may include a first bent portion 1325 provided to a front-located one of both ends of the first guide rail 132 so as to guide the door 135 to descend when the door 135 is closed. According to one embodiment, the first guide rail 132 may extend side by side with the one side of the tub cover 133 and be then inclined downward after passing through the first bent portion 1325.

Accordingly, when the door 135 slides to the one end of the first guide rail 132, i.e., the first bent portion 1325, the door 135 may be guided to completely cover the tub entrance by descending by a prescribed height, by which the idea of the present disclosure is non-limited. The first guide rail 132 may not include the first bent portion 1325. In this case, the door 135 may not descend by the prescribed height when sliding to one end of the first guide rail 132.

In some implementations, the tub cover 133 further include the second guide rail 134 provided to one side, i.e., the top side of the tub cover 133 in rear of the tub entrance 137 so as to guide the door 135 to slide to cover the tub entrance 137.

Thus, the door 135 may be guided to slide in a correct direction along the top side of the tub cover 133 by the second guide rail 134 as well as by the first guide rail 132, and the door may be prevented from being separated from the top side of the tub cover 133. In this case, as shown in FIG. 4, the second guide rail 134 may be singly provided on the top side of the tub cover 133 in rear of the tub entrance 137, by which the idea of the present disclosure is non-limited. Namely, two or more second guide rails 134 may be provided.

The second guide rail 134 may further include a second bent portion 1345 (not shown) provided to a front-located one of both ends of the second guide rail 134 to guide the door 135 to descend by a prescribed height when the door 135 is closed. According to one embodiment, the second guide rail 134 may extend side by side with the one side of the tub cover 133 and be then inclined downward to extend after passing the second bent portion 1345.

Accordingly, when the door 135 slides to the one end of the second guide rail 134, i.e., the second bent portion 1345, it may be guided to descend by a prescribed height to fully cover the tub entrance 137, by which the idea of the present disclosure is non-limited. Alternatively, the second guide rail 134 may not include the second bent portion 1345. In this case, the door 135 may not descend by the prescribed height when sliding to one end of the second guide rail 134.

Referring to FIG. 5, the laundry treatment apparatus 100 according to the present disclosure may further include a door opening detection sensor 136 provided to the one side of the tub cover 133 to detect the opening/closing of the door 135 in a manner of selectively contacting with the door 135 due to the sliding of the door 135.

The door opening detection sensor 136 may be configured to detect the opening/closing of the door 135 and forward an electrical signal to the control part 180 that may be controlled to perform a proper job such as washing, water supplying, notification signal transmission or the like in response to a status of the door 135.

In this case, the tub cover 133 may further include a sensor coupling part 139 to which the door opening detection sensor 136 is coupled, and the door opening detection sensor 136 may be coupled thereto in a manner of being seated on the sensor coupling part 139. The sensor coupling part 139 may be disposed on the one side of the tub cover 133 in rear of the tub entrance 137 in a manner of being spaced apart from the first guide rail 132 and/or the second guide rail 134.

In some implementations, the tub cover 133 may further include an auxiliary receiving part 138 configured to provide a space for receiving a portion of the door 135 therein and prevent the door 135 from being pushed forward when the door 135 is located at the one end of the first guide rail 132 and descends by a prescribed height. The auxiliary receiving part 138 may be configured to receive an auxiliary projection 1357 of the door 135, and a plurality of the auxiliary receiving parts 138 may be formed on the one side of the tub cover 133. According to one embodiment, the auxiliary receiving part 138 may be disposed in rear of the tub entrance 137 on the one side of the tub cover 133. According to one embodiment, the auxiliary receiving part 138 may be disposed between the first guide rail 132 and the second guide rail 134 by being spaced apart from them.

In addition, the tub cover 133 may further include a door seat part 1331 covering at least one portion of the top side of the tub cover 133 and configured to have the door 135 seated thereon and a leakage preventing part 1330 provided between the top side of the tub cover 133 and the door seat part 1331 to prevent water stored in the tub body 131 from leaking through the tub entrance 137 externally.

The door seat part 1331 may include a door coupling recess 1332 provided to a position corresponding to the door coupling part 1352 on the top side of the door seat part 1331 so as to be coupled to the door coupling part 1352. The door coupling part 1352 may be hook-coupled in a manner of being fitted into the door coupling recess 1332, whereby the door 135 may be fixed to the tub cover 133.

In some implementations, the door seat part 1331 may further include an auxiliary receiving part exposing recess 1338 that exposes the auxiliary receiving part 138 while coupled to the one side of the tub cover 133.

Referring to FIG. 6, the door seat part 1331 may include a sensor exposing part 1336 provided to a position corresponding to the sensor coupling part 139. Hence, a portion of the door opening detection sensor 136 may be exposed to the top side of the door seat part 1331 through the sensor exposing part 1336 while coupled to the sensor coupling part 139.

According to exemplary embodiments, each of the sensor coupling part 139, the door opening detection sensor 136 coupled to the sensor coupling part 139, and the sensor exposing part 1336 exposing a portion of the door opening detection sensor 136 may be disposed in a manner of being spaced apart from the second guide rail 134 in rear of the tub entrance 137.

In some implementations, the door seat part 1331 may further include a second guide rail exposing part 1334 provided to a position corresponding to the second guide rail 134 in rear of the door seat part 1331. Hence, while the door seat part 1331 is coupled to the top side of the tub cover 133, the second guide rail 134 may be exposed over the top side of the door seat part 1331 through the second guide rail exposing part 1334.

In addition, a lateral length of the door seat part 1331 may be smaller than a lateral length of the tub cover 133. Hence, while the door seat part 1331 is coupled to the top side of the tub cover 133, the first guide rail 132 may be exposed over the top side of the door seat part 1331.

Figure 7A:
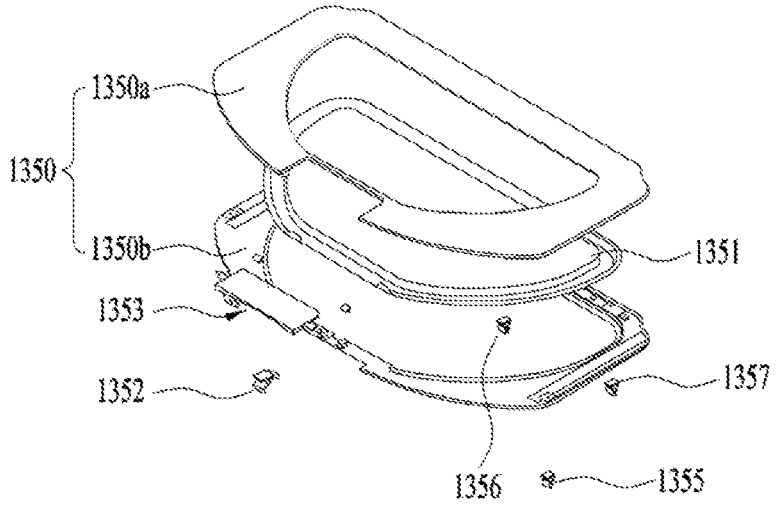
FIGS. 7A to 8 show a guide projection and a detection projection coupled to a bottom side of a door of the present disclosure.
Figure 7B:
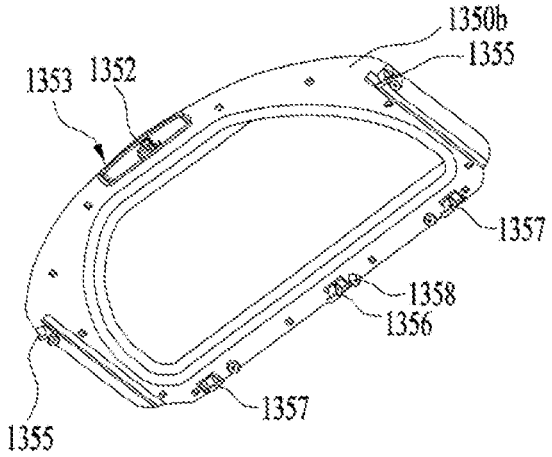
Figure 8:
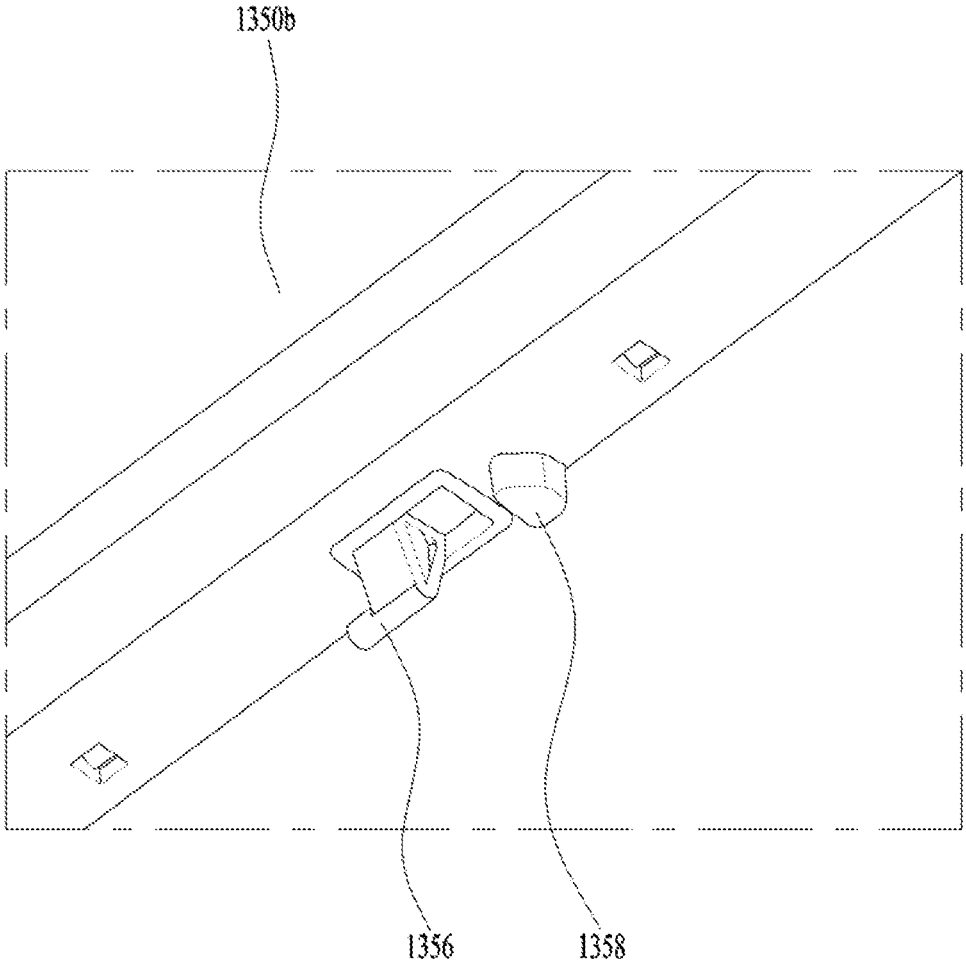

In the following, a configuration of the door 135 will be described in detail with reference to FIGS. 7A to 8 respectively showing a guide projection and a detection projection coupled to a bottom side of a door of the present disclosure. FIG. 7A is an exploded perspective diagram showing a configuration of a door, FIG. 7B is a perspective diagram showing a bottom structure of the door, and FIG. 8 is an enlarged perspective diagram showing an enlarged portion of FIG. 7B.

Referring to FIG. 7A, a door 135 may include a door frame 1350, a window 1351, a door coupling part 1352 and a handle 1353.

The door frame 1350 may include a top door frame 1350*a* and a bottom door frame 1350*b*. The window 1351 may be fixed in a manner of being coupled between the top and bottom door frames 1350*a* and 1350*b*.

The door coupling part 1352 and the handle 1353 may be disposed on a front side of the door frame 1350.

In some implementations, the door 135 may further include a first guide projection 1355 and a second guide projection 1356 coupled to a bottom side of the bottom door frame 1350*b* respectively.

Referring to FIG. 7B, the first guide projection 1355 may be configured to be movable while contacting with the first guide rail 132 in a manner of being coupled to a position corresponding to the first guide rail 132 on the bottom side of the bottom door frame 1350*b*, and the second guide projection 1356 may be configured to be movable while contacting with the second guide rail 134 in a manner of being coupled to a position corresponding to the second guide rail 134 on the bottom side of the bottom door frame 1350*b*.

In addition, the door 135 may further include an auxiliary projection 1357 coupled to the bottom side of the bottom door frame 1250*b*.

Referring to FIG. 7B, the auxiliary projection 1357 may be coupled to a position corresponding to the auxiliary receiving part 138 on the bottom side of the bottom door frame 1350*b*.

Referring to FIG. 7B and FIG. 8 together, the door 135 may further include a detection projection 1358 provided to a position corresponding to the sensor exposing part 1336 on the bottom side of the door 135 and configured to be capable of contacting with a portion of the door opening detection sensor 136 by perforating the door seat part 1331 through the sensor exposing part 1336.

The detection projection 1358 may be configured to contact with the door opening detection sensor 136 while the door 135 is fully closed or not to contact with the door opening detection sensor 136 while the door 135 is open.

In this case, the detection projection 1358 may be formed of material different from that of the bottom door frame 1350*b* and coupled to a position corresponding to the sensor exposing part 1336 on the bottom side of the bottom door frame 1350*b*, by which the idea of the present disclosure is non-limited. Namely, the detection projection 1358 may be formed of the same material of the bottom door frame 1350*b* and formed at a position corresponding to the sensor exposing part 1336 in a manner of being projected from the bottom side of the bottom door frame 1350*b*.

The detection projection 1358 may be disposed in a manner of being spaced apart from the first guide projection 1355 and/or the second guide projection 1356 and being also spaced apart from the auxiliary projection 1357.

Figure 10A:
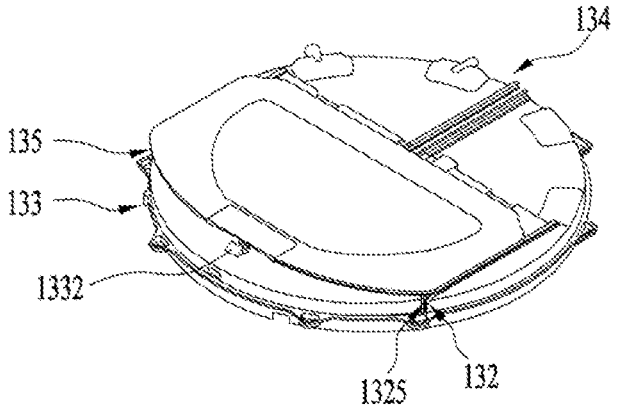
FIGS. 10A and 10B show a state that a door of the present disclosure is not fully closed.
Figure 10B:
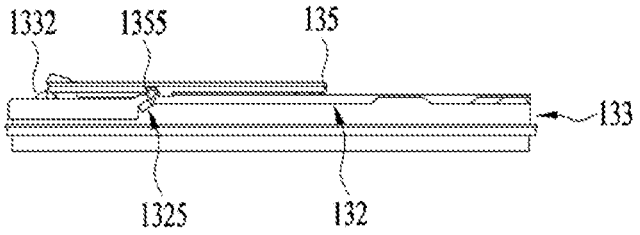
Figure 11A:
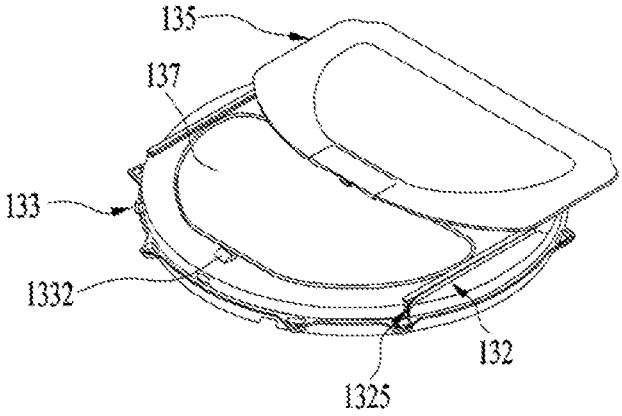
FIGS. 11A and 11B show a state that a door of the present disclosure is fully open.
Figure 11B:
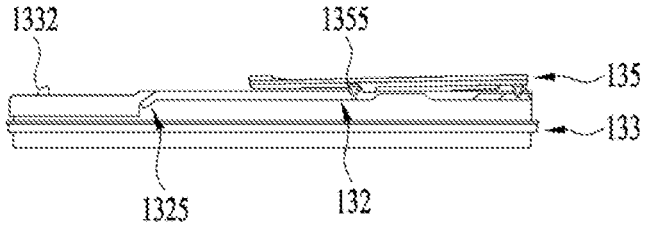

In the following, an open state and a closed state of a door will be described in detail with reference to FIGS. 9A to 11B. Here, FIGS. 9A to 9D show a state that a door of the present disclosure is fully closed, FIGS. 10A and 10B show a state that a door of the present disclosure is not fully closed, and FIGS. 11A and 11B show a state that a door of the present disclosure is fully open.

Referring to FIGS. 9A to 9D, the door 135 may be in a fully closed state of covering the tub entrance 137 on the tub cover 133.

Figures 9A, 9B, 9C, 9D:
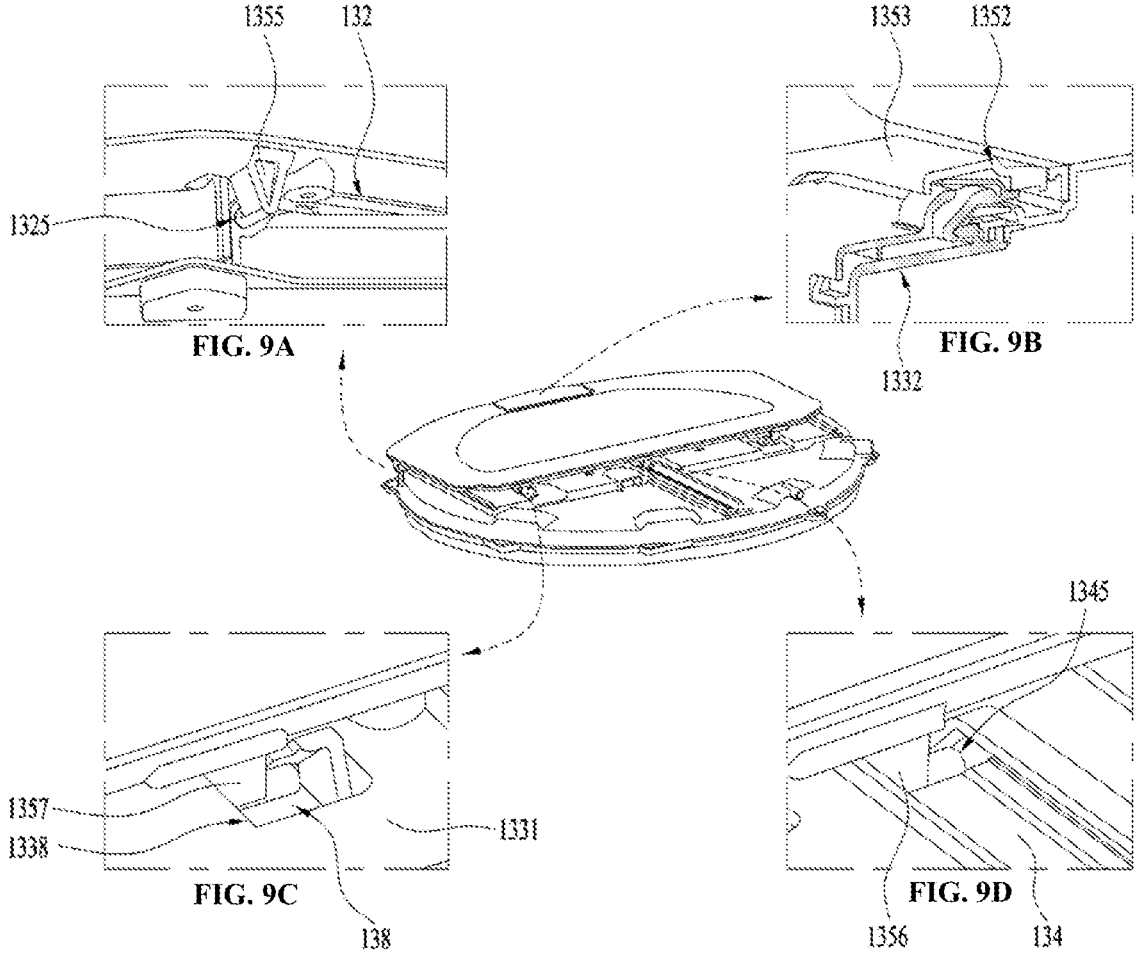
FIGS. 9A to 9D show a state that a door of the present disclosure is fully closed.

In particular, as shown in FIG. 9A, while the door 135 is fully closed, the first guide projection 1355 may slide to the one end of the first guide rail 132, i.e., the first bent portion 1325.

In addition, as shown in FIG. 9B, while the door 135 is fully closed, the door coupling part 1352 may be hook-coupled by being inserted in the door coupling recess 1332, whereby the door 135 may be fixed to the tub cover 133.

In addition, as shown in FIG. 9C, while the door 135 is fully closed, the auxiliary projection 1357 may be received in the auxiliary receiving part 138 in a manner of perforating the door seat part 1331 through the auxiliary receiving part exposing recess 1338.

In addition, as shown in FIG. 9D), while the door 135 is fully closed, the second guide projection 1356 may slide to the one end of the second guide rail 134, i.e., the second bent portion 1345.

Referring to FIGS. 10A and 10B, the door 135 may be in a state of failing to be fully closed despite being located above the tub cover 133 to cover the tub entrance 137.

In particular, in the state that the door 135 is not fully closed, the first guide projection 1355 may not slide to the one end of the first guide rail 132 and fail to enter the first bent portion 1325.

In addition, in the state that the door 135 is not fully closed, the door coupling part 1352 may not be inserted in the door coupling recess 1332 and the door coupling part 1352 and the door coupling recess 1332 may not be coupled together. Hence, the door 1332 may not be fixed to the tub cover 133.

In addition, in the state that the door 135 is not fully closed, the auxiliary projection 1357 may be located in rear of the auxiliary receiving part exposing recess 1338.

In addition, in the state that the door 135 is not fully closed, the second guide projection 1356 may not slide to the one end of the second guide rail 134 and fail to enter the second bent portion 1345.

Referring to FIGS. 11A and 11B, the door 135 may be in a fully open state by opening the tub entrance 137 above the tub cover 133.

In particular, in the state that the door 135 is fully open, the first guide projection 1355 may slide to the other end of the first guide rail 132 located on the opposite side of the one end of the first guide rail 132.

In addition, in the state that the door 135 is fully open, the door coupling part 1352 may not be inserted in the door coupling recess 1332 and the door coupling part 1352 and the door coupling recess 1332 may not be coupled together. According to one embodiment, the door coupling part 1352 may be located above the tub entrance 137.

In addition, in the state that the door 135 is fully open, the auxiliary projection 1357 may be located in rear of the auxiliary receiving part exposing recess 1338. According to one embodiment, the auxiliary projection 1357 may be located above the one side of the tub cover 133, i.e., the top side of the tub cover 133.

In addition, in the state that the door 135 is fully open, the second guide projection 1356 may slide to the other end of the second guide rail 134 located on the opposite side of the one end of the second guide rail 134.

Figure 12A:
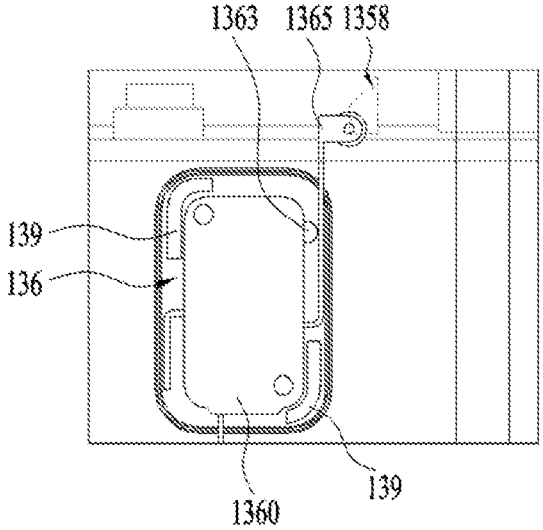
FIGS. 12A and 12B show an operation of a door opening detection sensor of the present disclosure.

In the following, an operation of a door opening detection sensor depending on a state of the door 135 will be described in detail based on FIGS. 12A and 12B. FIG. 12A is a top-view diagram showing a state that a door opening detection sensor is not activated, and FIG. 12B is a top-view diagram showing a state that a door opening detection sensor is activated.

Figure 12B:
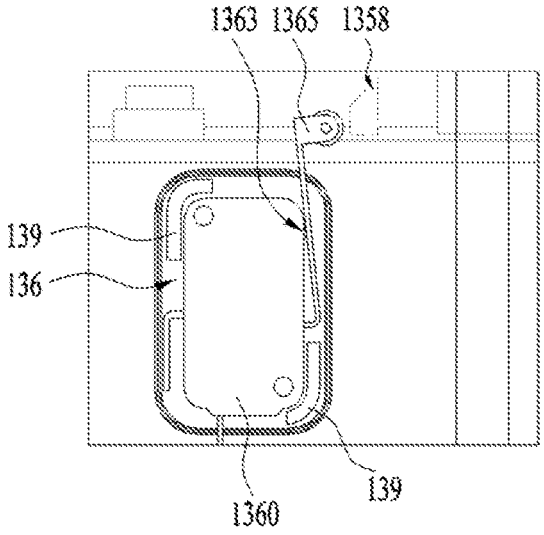

Referring to FIGS. 12A and 12B, the door opening detection sensor 136 may include a sensor body 1360 seated on the one side of the tub cover 133 and a switch part provided to one side of the sensor body 1360. The switch part may include a door contact part 1365 extended from the sensor body 1360 so as to be capable of contacting with the door 135 and a moving member 1363 provided between the sensor body 1360 and the door contact part 1365 so as to be retractable into the sensor body 1360.

According to exemplary embodiments, the door opening detection sensor 136 may be configured to be capable of contacting with the door 135 if the door 135 slides to the one end of the first guide rail 132. Namely, the door opening detection sensor 136 may be configured to be capable of contacting with the door 135 in a state that the door 135 is fully closed.

According to one embodiment, the door opening detection sensor 136 may be configured to be capable of contacting with the detection projection 1358 if the door slides to the first bent portion 1325 to descend by a prescribed height.

Namely, when the first guide projection 1355 is located at the one end of the first guide rail 132, the door opening detection sensor 136 contacts with the door 135, thereby detecting the closing of the door 135. On the other hand, when the first guide projection 1355 is located at the rest of the first guide rail 132 except the one end of the first guide rail 132, the door opening detection sensor 136 fails to contacts with the door 135, thereby detecting the opening of the door 135.

In addition, the door opening detection sensor 136 may be configured to be capable of contacting with the door 135 if the door 135 slides to the one end of the second guide rail 134. Namely, the door opening detection sensor 136 may be configured to be capable of contacting with the door 135 in a state that the door 135 is fully closed. According to one embodiment, the door opening detection sensor 136 may be configured to be capable of contacting with the detection projection 1358 if the door 135 slides to the second bent portion 1345 to descend by a prescribed height.

Namely, when the second guide projection 1356 is located at the one end of the second guide rail 134, the door opening detection sensor 136 contacts with the door 135, thereby detecting the closing of the door 135. On the other hand, when the second guide projection 1356 is located at the rest of the second guide rail 134 except the one end of the second guide rail 134, the door opening detection sensor 136 fails to contacts with the door 135, thereby detecting the opening of the door 135.

In other words, when the door 135 is fully closed, as the door contact part 1365 contacts with the door 135 and pushes the moving member 1363 into the sensor body 1360, the door opening detection sensor 136 may detect the closing of the door 135.

According to the exemplary embodiments, the detection projection 1358 may be configured to contact with the door contact part 1365 of the switch part in a manner of descending by a prescribed height when the door 135 is fully closed. And, the detection projection 1358 may be configured not to contact with the door contact part 1365 of the switch part in a manner of ascending by a prescribed height when the door 135 is open. Therefore, the door opening detection sensor 136 may detect the opening/closing of the door 135 depending on a presence or non-presence of the contact between the detection projection 1358 and the door contact part 1365 of the switching part.

The door opening detection sensor 136 may detect the state that the detection projection 1358 included in the door 135 contacts with the door contact part 1365 of the switch part, thereby detecting that the door 135 is closed. The door opening detection sensor 136 may detect the state that the detection projection 1358 included in the door 135 fails to contact with the door contact part 1365 of the switch part, thereby detecting that the door 135 is open.

Namely, the door opening detection sensor 136 may detect the state that the moving member 1363 has been retracted into the sensor body 1360 by the door contact part 1365, thereby detecting that the door 135 is closed. On the other hand, the door opening detection sensor 136 may detect the state that the moving member 1363 is not retracted into the sensor body 1360, thereby detecting that the door 135 is open.

According to one embodiment, when the door 135 is closed, as the detection projection 1358 descends together with the door 135 and pushes the door contact part 1365, the moving member 1363 is retracted into the sensor body 1360. Thus, the door opening detection sensor 136 may detect the opening/closing of the door 135.

As described above, the laundry treatment apparatus 100 according to the exemplary embodiments of the present disclosure may include the door 135 slidable along a top side of the tub 130.

Therefore, even of a main laundry treatment apparatus of a front-load type is provided above the laundry treatment apparatus 100, the door 135 included in the laundry treatment apparatus 100 may possibly avoid colliding with a front door of the main laundry treatment apparatus.

In addition, the door 135 of the laundry treatment apparatus 100 may be open correctly even if the drawer 120 fails to be fully withdrawn from the cabinet 110.

In addition, when laundry is put into the laundry treatment apparatus 100 or laundry received in the laundry treatment apparatus 100 is withdrawn, the door 135 of the laundry treatment apparatus 100 may not need an additional fixing member to maintain a fully-open state.

In addition, when water remaining in the tub 130 is removed after completion of washing, the laundry treatment apparatus 100 may maintain an open state by sliding the door 135 irrespective of a presence or non-presence of withdrawal of the drawer 120, whereby it is unnecessary to withdraw the drawer 120 from the cabinet 110 for the drying of the tub 130. Therefore, when the tub 130 is dried, an additional space for withdrawing the drawer 120 from the cabinet 110 may be unnecessary.

In addition, when the tub 130 is dried, the laundry treatment apparatus 100 does not need to withdraw the drawer 120 from the cabinet 110. Hence, the laundry treatment apparatus may avoid the inconvenience caused by the drawer 120 withdrawn from the cabinet 110 to interrupt a user's motion and further lower a possibility that there will be a risk of injury as the user trips over the drawer 120 withdrawn from the cabinet 110.

In some implementations, the laundry treatment apparatus 100 according to exemplary embodiments of the present disclosure may include the door opening detection sensor 136 configured to detect opening or closing of the door 135 in a manner of selectively contacting with the door 135 as the door 135 slides.

Therefore, although the door 135 fails to be rotatably hinge-coupled to the top side of the tub 130, the opening/closing of the door 135 can be detected effectively.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for treating laundry, comprising:

a cabinet that defines an opening at a front side thereof;

a drawer body configured to insert into and withdraw from the cabinet through the opening of the cabinet;

a tub comprising (i) a tub body disposed within the drawer body and configured to receive water and (ii) a tub cover coupled to a top side of the tub body, the tub cover defining a tub entrance configured to introduce the laundry therethrough, wherein the tub entrance is defined at a front side of the tub cover, a drum rotatably disposed within the tub body and configured to accommodate the laundry, the drum defining a drum entrance that is in communication with the tub entrance and configured to receive the laundry introduced through the tub entrance;

a driver disposed below a bottom side of the tub body and configured to supply power for rotating the drum;

a door configured to slide along a top side of the tub cover, the door being configured (i) to move toward the front side of the tub cover to thereby close the tub entrance and (ii) to move toward a rear side of the tub cover to thereby open the tub entrance; and a door opening detection sensor disposed at the tub cover and configured to detect whether the door is opened or closed based on contacting the door that slides along the top side of the tub, wherein the tub cover comprises a first guide rail and a second guide rail, wherein the second guide rail comprises a second bent portion disposed at an end of the second guide rail and configured to guide the door to a lower position relative to a reference position by a prescribed height based on the door closing the tub entrance, and wherein the door opening detection sensor is configured to contact the door based on the door sliding to the second bent portion.

2. The apparatus of claim 1, wherein the first guide rail is disposed at at least one side of the tub entrance, the first guide rail being configured to guide the door to slide toward and away from the tub entrance, and wherein the door opening detection sensor is configured to contact the door based on the door sliding to an end of the first guide rail.

3. The apparatus of claim 2, wherein the first guide rail comprises a first bent portion disposed at the end of the first guide rail and configured to guide the door to an upper position relative to the reference position by a prescribed height based on the door closing the tub entrance, and wherein the door opening detection sensor is configured to contact the door based on the door sliding to the first bent portion.

4. The apparatus of claim 3, wherein the first guide rail extends along a side of the tub cover and is inclined downward to connect to the first bent portion.

5. The apparatus of claim 2, wherein the door comprises a first guide projection that is disposed at a bottom side of the door and that faces the first guide rail, the first guide projection being configured to move based on movement of the door while contacting the first guide rail, and wherein the door opening detection sensor is configured to:

based on the first guide projection being positioned at the end of the first guide rail, contact the door to thereby detect that the door is closed, and based on the first guide projection being positioned at positions other than the end of the first guide rail, separate from with the door to thereby detect that the door is opened.

6. The apparatus of claim 2, wherein the second guide rail is disposed at a rear side of the tub entrance and configured to guide the door to slide toward and away from the tub entrance, and wherein the door opening detection sensor is configured to contact the door based on the door sliding to an end of the second guide rail.

7. The apparatus of claim 1, wherein the door further comprises a second guide projection that is disposed at a bottom side of the door and that faces the second guide rail, the second guide projection being configured to move based on movement of the door while contacting the second guide rail, and wherein the door opening detection sensor is configured to:

based on the second guide projection being positioned at the second bent portion, contact the door to thereby detect that the door is closed, and based on the second guide projection being positioned at positions other than the second bent portion, separate from the door to thereby detect that the door is opened.

8. The apparatus of claim 1, wherein the tub cover comprises a sensor coupler disposed at a side of the tub cover and coupled to the door opening detection sensor, the sensor coupler being disposed at a rear side of the tub entrance.

9. The apparatus of claim 8, wherein the tub cover further comprises a door seat that covers at least a portion of the top side of the tub cover and that supports the door, and wherein the door seat defines a sensor exposing hole at a position corresponding to the sensor coupler.

10. The apparatus of claim 9, wherein a portion of the door opening detection sensor is exposed above the door seat through the sensor exposing hole.

11. The apparatus of claim 10, wherein the door further comprises a detection projection disposed at a bottom side of the door and coupled to a position corresponding to the sensor exposing hole, and wherein the detection projection is configured to contact a portion of the door opening detection sensor based on the detection projection passing through the sensor exposing hole of the door seat.

12. The apparatus of claim 1, wherein the door opening detection sensor comprises:

a sensor body disposed at a side of the tub cover; and a switch disposed at a side of the sensor body, the switch comprising:

a door contact part that extends from the sensor body and is configured to contact the door, and a moving member disposed between the sensor body and the door contact part and configured to be retracted into the sensor body.

13. The apparatus of claim 12, wherein the door opening detection sensor is configured to detect that the door is closed based on the door contact part contacting the door and pushing the moving member into the sensor body.

14. The apparatus of claim 1, wherein the tub cover comprises:

the first guide rail that is disposed at at least one side of the tub entrance and configured to guide the door to slide along the tub cover;

the second guide rail that is disposed at a rear side of the tub entrance and configured to guide the door to slide along the tub cover; and a sensor coupler disposed at a side of the tub cover and coupled to the door opening detection sensor, the sensor coupler being spaced apart from the second guide rail.

15. The apparatus of claim 14, wherein the door comprises:

a first guide projection that is disposed at a bottom side of the door and faces the first guide rail, the first guide projection being configured to move based on movement of the door while contacting the first guide rail;

a second guide projection that is disposed at the bottom side of the door and faces the second guide rail, the second guide projection being configured to move based on movement of the door while contacting the second guide rail; and a detection projection disposed at a position corresponding to the sensor coupler and spaced apart from the second guide projection.

16. The apparatus of claim 15, wherein the door opening detection sensor comprises:

a sensor body disposed at the side of the tub cover; and a switch disposed at a side of the sensor body, and wherein the detection projection is aligned with at least a portion of the switch when viewed above the door.

17. The apparatus of claim 16, wherein the detection projection is configured to:

contact the switch based on the door closing the tub entrance and moving to the lower position relative to the reference position by a first prescribed height; and separate from the switch based on the door opening the tub entrance and moving to an upper position relative to the reference position by a second prescribed height, and wherein the door opening detection sensor is configured to detect whether the door is opened or closed based on a contact between the detection projection and the switch.

18. An apparatus for treating laundry, comprising:

a cabinet that defines an opening at a front side thereof;

a drawer body configured to insert into and withdraw from the cabinet through the opening of the cabinet;

a tub comprising a tub body disposed within the drawer body and configured to receive water therein and a tub cover coupled to a top side of the tub body, the tub cover defining a tub entrance configured to introduce the laundry therethrough, wherein the tub entrance is defined at a front side of the tub cover;

a drum rotatably disposed within the tub body and configured to accommodate the laundry, the drum defining a drum entrance that is in communication with the tub entrance and configured to receive the laundry introduced through the tub entrance;

a driver disposed below a bottom side of the tub body and configured to supply power for rotating the drum;

a door coupled to a top side of the tub and configured to slide along the tub cover, the door being configured (i) to move toward the front side of the tub cover to thereby close the tub entrance and (ii) to move toward a rear side of the tub cover to thereby open the tub entrance; and a door opening detection sensor disposed at the tub cover and configured to detect whether the door is opened or closed, the door opening detection sensor comprising a sensor body disposed at a side of the tub cover and a switch disposed at a side of the sensor body, wherein the door opening detection sensor is configured to:

detect that the door is closed based on the door contacting the switch, and detect that the door is opened based on the door being separated from the switch, wherein the tub cover comprises a first guide rail and a second guide rail, wherein the second guide rail comprises a second bent portion disposed at an end of the second guide rail and configured to guide the door to a lower position relative to a reference position by a prescribed height based on the door closing the tub entrance, and wherein the door opening detection sensor is configured to contact the door based on the door sliding to the second bent portion.

19. The apparatus of claim 18, wherein the switch comprises:

a door contact part that extends from the sensor body and configured to contact the door; and a moving member disposed between the sensor body and the door contact part and configured to be retracted into the sensor body, and wherein the door opening detection sensor is configured to:

detect that the door is closed based on the door contact part pushing the moving member into the sensor body, and detect that the door is opened based on the moving member being located outside the sensor body.

20. The apparatus of claim 19, wherein the door comprises:

a detection projection disposed at a bottom side of the door and coupled to a position corresponding to an end of the door contact part, the detection projection being configured to:

contact the door opening detection sensor based on the door closing the tub entrance, and separate from the door opening detection sensor based on the door opening the tub entrance.

21. The apparatus of claim 20, wherein the door is configured to move downward to the lower position relative to the reference position by the prescribed height based on the door switching from an open state to a closed state, and wherein the door opening detection sensor is configured to detect whether the door is opened or closed based on whether the door contact part pushes the moving member into the sensor body while the detection projection moves downward together with the door.

* * * * *